US007661804B2

(12) United States Patent
Chung et al.

(10) Patent No.: US 7,661,804 B2
(45) Date of Patent: Feb. 16, 2010

(54) INK RECHARGE SYSTEM AND INK RECHARGE METHOD FOR INK CARTRIDGE

(75) Inventors: Kwang-Choon Chung, Yongin (KR); Chang-Soo Yu, Suwon-si (KR); Hae-Sung Jung, Seoul (KR); Ki-Hun Kang, Sungnam-si (KR); Ki-Yong Kim, Gwnagju-si (KR); Jeong-Guck Lee, Sungnam-si (KR); Chung-Il Kim, Sungnam-si (KR)

(73) Assignee: INKTEC Co., Ltd. (KR)

( * ) Notice: Subject to any disclaimer, the term of this patent is extended or adjusted under 35 U.S.C. 154(b) by 404 days.

(21) Appl. No.: 11/485,717

(22) Filed: Jul. 13, 2006

(65) Prior Publication Data

US 2007/0146448 A1 Jun. 28, 2007

(30) Foreign Application Priority Data

Dec. 23, 2005 (KR) ..... 10-2005-0128948

(51) Int. Cl.
*B41J 2/175* (2006.01)

(52) U.S. Cl. ..... 347/86; 347/85

(58) Field of Classification Search ..... 347/19, 347/84–87; 141/18–29
See application file for complete search history.

(56) References Cited

U.S. PATENT DOCUMENTS 5,136,884 A * 8/1992 Lovett ..... 73/313
5,212,444 A * 5/1993 Abramovich et al. .. 324/207.13
5,421,193 A * 6/1995 Carlin et al. ..... 73/49.2
5,731,824 A * 3/1998 Kneezel et al. ..... 347/7
6,024,429 A * 2/2000 Coffy et al. ..... 347/7
6,067,854 A * 5/2000 Yang ..... 73/305
6,402,306 B1 * 6/2002 Childers et al. ..... 347/85
6,536,861 B1 * 3/2003 Usui et al. ..... 347/7
6,796,627 B2 * 9/2004 Kimura et al. ..... 347/7
7,250,128 B2 * 7/2007 Unger et al. ..... 264/155
2004/0012645 A1 * 1/2004 Kinalski et al. ..... 347/7
2006/0244791 A1 * 11/2006 Chung et al. ..... 347/85
2008/0100681 A1 * 5/2008 Tyvoll et al. ..... 347/86

FOREIGN PATENT DOCUMENTS

KR 1020030069596 A 8/2003
WO WO 2004091920 A1 * 10/2004

* cited by examiner

*Primary Examiner*—Stephen D Meier
*Assistant Examiner*—Rene Garcia, Jr.
(74) *Attorney, Agent, or Firm*—Cantor Colburn LLP

(57) ABSTRACT

An ink cartridge recharge system includes an ink cartridge mount hole in which an ink cartridge is mounted. The ink cartridge mount hole includes an ink injection part in which an ink injection hole connected to a nozzle of the ink cartridge is formed. A magnetostrictive displacement transducer is connected to the ink injection hole through an ink supply tube and determines the charged amount of ink by sensing displacement of magnetic field due to displacement of an internal float. A positive pressure tank stores high pressure air by a compressor. A bulk cartridge is connected to one side of the magnetostrictive displacement transducer to supply ink to be charged. A negative pressure tank is connected to the ink injection hole of the ink cartridge mount hole through a vacuum tube.

15 Claims, 10 Drawing Sheets

INK RECHARGE SYSTEM AND INK RECHARGE METHOD FOR INK CARTRIDGE

This application claims benefit under 35 U.S.C. § 119 from Korean Patent Application No. 2005-0128948, filed on Dec. 23, 2005, the entire content of which is incorporated herein by reference.

BACKGROUND OF THE INVENTION

1. Field of the Invention

The present invention relates to an ink recharge system capable of repeatedly recharging a proper amount of ink in an ink cartridge using magnetostrictive displacement transducers, and a method of recharging ink in the ink cartridge.

2. Description of the Related Art

Empty ink cartridges are recycled since the price of ink cartridges that are consumption goods are relatively high compared with the price of the main bodies of inkjet printers and interests in protection of environments have increased. In order to recycle the ink cartridge, a user purchases ink to inject the ink into the used ink cartridge using a simple tool, purchases a substitute ink cartridge whose specification is the same as the specification of the ink cartridge mounted in the main body of the inkjet printer when the inkjet printer was purchased to mount the ink cartridge in the inkjet printer, or purchases a recharge ink cartridge suitable for the inkjet printer to repeatedly recharge the ink cartridge.

As a method of recharging ink in the used ink cartridge, an ink cartridge recharge system designed to let a specialized businessman provide an ink recharge service to a consumer is disclosed in the Korean Patent Publication No. 10-2003-69596 (published on Aug. 27, 2003). The ink cartridge recharge system is designed to recharge ink by simply manipulating switches manipulation after mounting an ink cartridge out of which ink is consumed in a cartridge mount hole. Other than the above, a plurality of methods of injecting black ink through a nozzle having a single injection hole are well known. However, in the case of a color ink cartridge, a method of injecting ink by a needle through an additional recharge hole is mainly used and a method of injecting ink of a plurality of colors through nozzles having a plurality of injection holes is not commonly used.

Next, an ink cartridge recharge system 100 disclosed in the above Korean Patent Publication that is a conventional prior art will be simply described with reference to FIGS. 1 to 3.

FIG. 1 schematically illustrates the conventional ink cartridge recharge system 100. The ink cartridge recharge system 100 includes cartridge mount holes 110 in which ink cartridges are mounted, reservoirs 120 for temporarily storing ink to supply the ink to the ink cartridges through ink injection tubes 101, ink tanks 140 for supplying ink to the reservoirs 120 through ink supply tubes 102, and cylinders 130 connected to compression pumps 150 through air tubes.

The operation of the ink cartridge recharge system 100 will be described as follows. When switches 104 are turned on after mounting the ink cartridges in the cartridge mount holes 110, pistons (not shown) provided in the cylinders apply pressure to the reservoirs 120 by the air pressure from the compression pumps so that the ink is supplied to the ink cartridges. When the ink is completely recharged, the pressure in the cylinders 130 and the reservoirs 120 is reduced so that the ink is supplied from the ink tanks 140 to the reservoirs 120 and that it is ready to inject the ink next time.

In the ink cartridge recharge system 100 illustrated in FIG. 1, the three ink injection tubes 101 and the three ink supply tubes 102 are for supplying cyan ink, magenta ink, and yellow ink and check valves 101*a* and 102*a* are provided in each of the ink injection tubes 101 and the ink supply tubes 102 so that the ink supplied to ink cartridges 1 and the reservoirs 120 does not flow backward. Storage spaces in the ink tanks 140, the cylinders 130, and the reservoirs 120 are provided for the respective colors.

As illustrated in FIGS. 2 and 3, the cartridge mount hole 110 includes a body 111 in which the ink cartridge 1 is settled, an ink injection part 112 to which nozzles 2 of the ink cartridge 1 are attached, and a cartridge fix part 120 positioned on the opposite side to the nozzle 2. The cartridge fix part 120 is designed so that a sliding bar 122 moves forward and backward by a link 123 when a handle 121 is rotated upward and downward. An elastic member 124 is combined with the leading end of the sliding bar 122 so that excessive force is not applied to the ink cartridge 1 when the ink cartridge 1 is fixed. Ink injection holes 113 corresponding to the nozzles 2 are formed in the ink injection part 112 attached to the nozzles 2 of the ink cartridge 1. The ink injection tubes 101 are connected to the ink injection holes 113 by connectors 115.

The above-described ink cartridge recharge system has the following limitations although it has an advantage in that ink can be recharged by simply manipulating the switches after the ink cartridges are mounted in the cartridge mount holes.

That is, in the case where the ink is recharged through the nozzles of the ink cartridge using the air pressure as illustrated with reference to the ink cartridge recharge system 100, when the ink is completely recharged, the internal pressure (the pressure generated by the air that exists in the ink cartridge and the injected ink) of the ink cartridge 1 becomes larger than the air pressure. Therefore, when the ink cartridge 1 in which the ink is completely recharged is attached to and detached from the cartridge mount hole 110, the ink in the ink cartridge 1 is blown off through the nozzles 2 or the ink that exists in spaces between the nozzles 2 and the ink injection part 112 overflows so that the nozzles and the cartridge mount hole 110 are covered with the ink.

The ink cartridge 1 is divided into a sponge type and a pack type in accordance with a method of storing ink therein. In particular, in the case of the pack type, the ink leaks or an excessive amount of ink is sprayed through the nozzles at the initial stage of printing due to increase in the internal pressure caused by the air that resides in the ink cartridge after the ink is completely recharged so that the quality of printing deteriorates. In order to prevent such a problem, when the ink is completely recharged in the ink cartridge, it is necessary to take out small amounts of the air and ink that reside in the ink cartridge to regulate the internal pressure of the ink cartridge. However, according to the ink cartridge recharge system 100, it is difficult to regulate the internal pressure of the ink cartridge.

Furthermore, it is difficult to apply the ink cartridge recharge system 100 to ink cartridges having various shapes and capacities. That is, whenever the kind of the ink cartridge mounted in the cartridge mount hole 110 changes, it is necessary to previously regulate the length of the sliding bar 122 so that proper fixation force is applied to the ink cartridge. Also, in order to inject ink having the amount suitable for the capacity of the mounted ink cartridge, since it is necessary to regulate ink supply amount regulators 131 to regulate the displacement of the pistons in the cylinders 130, it is difficult to inject a proper amount of ink.

According to the ink cartridge recharge system 100, since only the check valves 101*a* are provided in the ink injection tubes 101 so that the ink does not flow backward to the reservoirs 120, a small amount of ink resides in the ink injection holes 113 after the ink cartridge is completely recharged. Therefore, when the corresponding cartridge mount hole 110 is not used for a moment after the ink is recharged, the quality of injected ink may deteriorate due to the ink that resides in the ink injection holes 113. When the ink whose quality deteriorates is recharged in the ink cartridge, the quality of printing deteriorates and the nozzles of the ink cartridge may be clogged.

SUMMARY OF THE INVENTION

The present invention has been developed in order to solve the above and other problems associated with the related art. A feature of the present invention is to provide an ink cartridge recharge system capable of easily discharging the air and ink that reside in a recycled ink cartridge, of precisely regulating the degree of vacuum of the inside of the ink cartridge, and of rapidly and correctly recharging a proper amount of ink using magnetostrictive displacement transducers.

Furthermore, another feature of the present invention is to provide an effective method of recharging an ink cartridge in which the ink cartridge is applied to the ink cartridge recharge system.

In order to achieve the features of the present invention, there is provided an ink cartridge recharge system comprising an ink cartridge mount hole in which an ink cartridge is mounted and that includes an ink injection part in which ink injection holes connected to nozzles of the ink cartridges are formed, magnetostrictive displacement transducers connected to the ink injection part through ink supply tubes, a positive pressure tank in which high pressure air is stored by a compressor, bulk cartridges connected to one side of each of the magnetostrictive displacement transducers to supply ink to be charged, and a negative pressure tank connected to the ink injection holes through a vacuum tube to discharge the air and ink by a vacuum pump so that the internal pressure of the ink cartridge is regulated after charging the ink or to suck the ink that resides in the ink injection part after charging the ink.

Also, the ink cartridge mount hole further comprises an air discharge part in which an air discharge hole connected to an air hole of the ink cartridge is formed to face the ink injection part. In this case, the air discharge hole is connected to the negative pressure tank by the vacuum tube.

In order to charge a proper amount of ink, the ink cartridge recharge system adopts the magnetostrictive displacement transducers that convert the displacement of floats therein into current difference to measure the level of the charged ink and to precisely control the amount of the ink.

Also, the ink cartridge mount hole further comprises a fix member for settling and mounting an ink cartridge and for fixing the ink cartridge so that the nozzles of the ink cartridge and the ink injection holes and the air hole of the ink cartridge and the air discharge hole of the air discharge part are tightly connected to each other. In the fix member, a sliding bar having an elastic member compresses the ink cartridge by a handle.

Also, the fix member tightly connect the nozzles of the ink cartridge and the ink injection holes to each other and the air hole of the ink cartridge and the air discharge part to each other in a vertical direction using compressed air reservoirs that store the air compressed by a compressor to mount the ink cartridge in the mount hole.

In the ink cartridge recharge system, a plurality of mount holes in which black ink and color ink components are recharged are provided. The plurality of black ink magnetostrictive displacement transducers are provided and a set of magnetostrictive displacement transducers for ink of a plurality of colors are provided. Each of the ink injection holes of the ink injection part has single aperture and each of the ink injection holes of the ink injection part has as many apertures as the number of colors of ink.

On the other hand, in the ink cartridge recharge system, the reciprocating motion of the floats in the magnetostrictive displacement transducers is controlled by a pneumatic tube or a vacuum tube alternately connected to the pneumatic regulators of the magnetostrictive displacement transducers in accordance with an ink charge period by the opening and closing operation of a pneumatic solenoid valve provided in the center of a compressed air supply tube.

A check valve or an open and close valve that repeats opening and closing operations in connection with the opening and closing operation of the pneumatic solenoid valve is provided between the bulk ink cartridges and the magnetostrictive displacement transducers to control ink supply from the bulk ink cartridges. Also, a check valve or an opening and closing valve that repeats opening and closing operations in connection with the opening and closing operations of the pneumatic solenoid valve is provided between the magnetostrictive displacement transducers and the ink injection parts of the ink cartridge so that the valve is opened when ink is charged and is closed when ink is completely charged and that the vacuum tube is connected to the pneumatic regulators of the magnetostrictive displacement transducers. As a result, negative pressure is applied to the magnetostrictive displacement transducers.

A positive pressure tank is connected to a compressed air supply tube through a supplementary positive pressure tank and a negative pressure tank is connected to a vacuum tube through a supplementary negative pressure tank so that the positive pressure tank and the negative pressure tank operate as buffers when the pressures and degrees of vacuum of the positive pressure tank and the negative pressure tank are transmitted through the compressed air supply tube and the vacuum tube.

Additionally, the ink charge system is connected to the bulk ink cartridge in which two ink supply teeth made of a conductive material and having different heights that suck ink are provided to determine whether the ink stored in the bulk ink cartridge is consumed. It is determined whether the ink is consumed using the principle in which current does not flow when the water level of the ink is lower than one of the conductive electrode teeth.

On the other hand, an electronic scale for measuring whether ink resides in the ink cartridge is additionally provided in a predetermined part of the ink recharge system. The weight of the recycle cartridge placed on the electronic scale is compared with a previously set value. When the comparison result is within an error range, it is determined that the amount of ink that resides in the ink cartridge is no more than an allowable amount so that it is allowed to recharge ink. When the comparison result is out of the error range, a warning message that informs that it is necessary to discharge the ink that resides in the ink cartridge is displayed on the touch screen.

Simple distinguish members whose upper, lower, or center parts are opened are attached to the bulk ink cartridge so that it is possible to prevent the ink cartridge from being erroneously mounted. The distinguish members are attached to the grooves on both sides of the bulk ink cartridge in the form of combination so that a plurality of number of cases are generated.

There is provided a method of recharging an ink cartridge using the ink cartridge recharge system, the method comprising the operations of mounting an ink cartridge in an ink cartridge mount hole, discharging air and ink that reside in the ink cartridge by opening and closing operations of an open and close valve provided in a vacuum tube that connects a negative pressure tank and ink injection holes connected to ink cartridge nozzles to each other, connecting a vacuum tube to pneumatic regulators of magnetostrictive displacement transducers by opening and closing operations of a pneumatic solenoid valve provided in a vacuum tube from a negative pressure tank so that negative pressure is applied to the magnetostrictive displacement transducers and that a proper amount of ink is supplied from bulk ink cartridges, supplying the air pressure to the regulators of the magnetostrictive displacement transducers by changed opening and closing operations of the pneumatic solenoid valve to charge the ink of the magnetostrictive displacement transducers in the ink cartridge through ink supply tubes, stopping ink supply of the magnetostrictive displacement transducers when it is determined by a proper amount level control means that a proper amount of ink is supplied, and sucking air and ink that reside in the ink cartridge or ink injection holes by opening and closing operations of an open and close valve provided in the vacuum tube to regulate the internal pressure of the ink cartridge to which ink is supplied or to suck the ink that resides in the ink injection holes.

In the charge operation, the inside of the ink cartridge is made vacuous by the opening and closing operations of the opening and closing valve provided in the vacuum tube for connecting the air hole of the ink cartridge to the air discharge hole of the air discharge part formed in the ink cartridge mount hole to facilitate ink charge to the ink cartridge.

There is provided a method of recharging an ink cartridge using an ink cartridge recharge system, the method comprising the operations of measuring weight of a recharge ink cartridge by an electronic scale, calculating an amount of ink to be charged in consideration of a predetermined target charge amount and the weight of the ink cartridge, designating a cartridge mount hole in which the ink cartridge is to be mounted, and charging the amount of ink to be charged by a predetermined charge input command after the ink cartridge is mounted in the designated mount hole. The amount of ink to be charged is automatically calculated by inputting a specification of a cartridge to be recharged. The designation of the mount hole and the charge input command are performed through a touch screen. Residing ink is commonly discharged before recharging the ink cartridge. However, it is an aspect of the present invention to provide a method of rapidly recharging ink without discharging the ink. To be specific, the weight of the ink cartridge in which ink resides is measured by the electronic scale and the weight is compared with the weight of the ink cartridge in which no ink resides so that the amount of residing ink is correctly measured to previously calculate the amount of ink to be additionally charged. The above values are displayed on the touch screen. The mount hole in which the ink cartridge is to be mounted is designated by the touch screen and the ink cartridge is mounted in the designated mount hole. Then, it is instructed to charge ink only by the amount manipulated by the input command button of the touch screen and recharge is completed. Therefore, it is possible to omit the ink discharge process.

BRIEF DESCRIPTION OF THE DRAWINGS

The above aspects and features of the present invention will be more apparent by describing certain embodiments of the present invention with reference to the accompanying drawings, in which:

FIGS. 2 and 3 are side views schematically illustrating the cartridge mount hole illustrated in FIG. 1, in which FIG. 2 illustrates a state before the ink cartridge is attached and fixed to the cartridge mount hole and FIG. 3 illustrates a state after the ink cartridge is attached and fixed to the cartridge mount hole;

DETAILED DESCRIPTION OF THE PREFERRED EMBODIMENTS

An ink cartridge recharge system according to preferred embodiments of the present invention will be described in greater detail with reference to the accompanying drawings.

Figure 1:
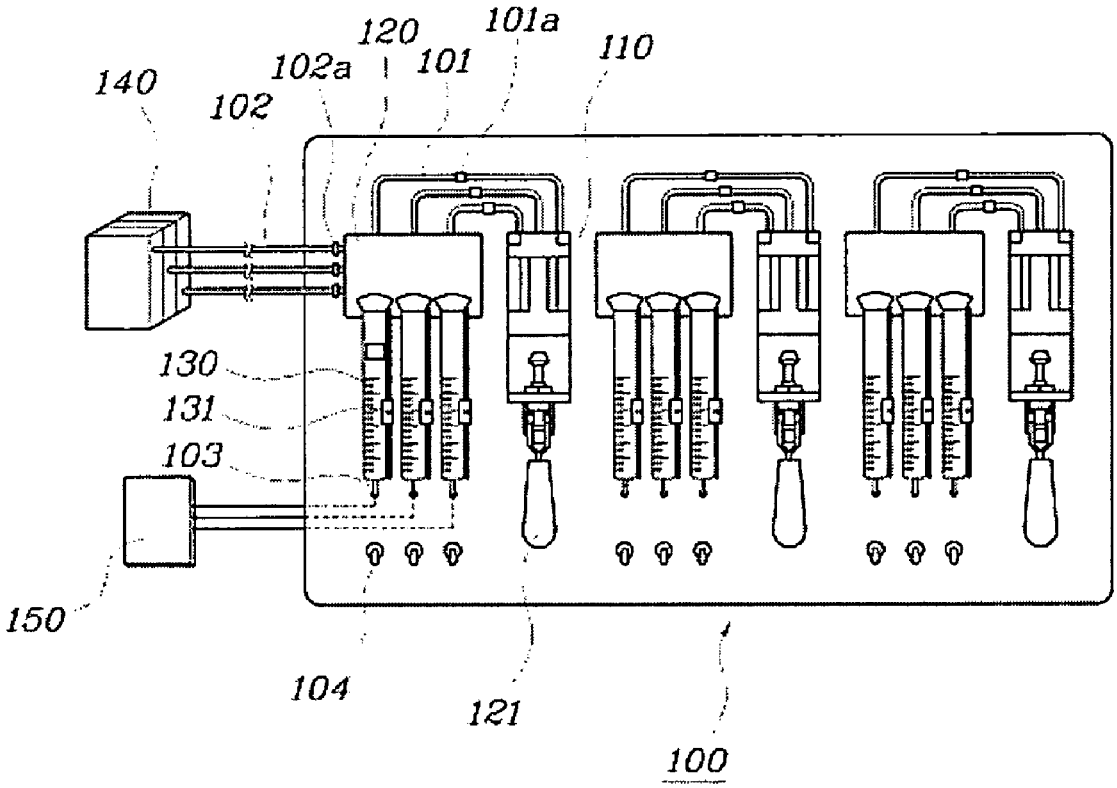
FIG. 1 Prior art
FIG. 1 schematically illustrates a conventional ink cartridge recharge system.
Figure 2:
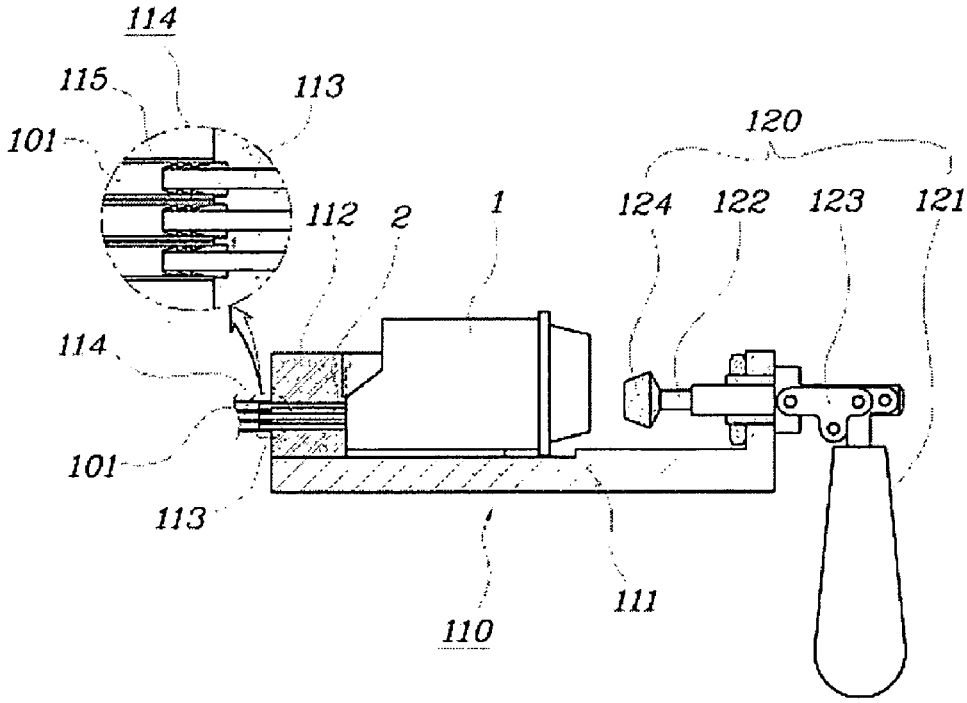
FIG. 2 Prior art
Figure 3:
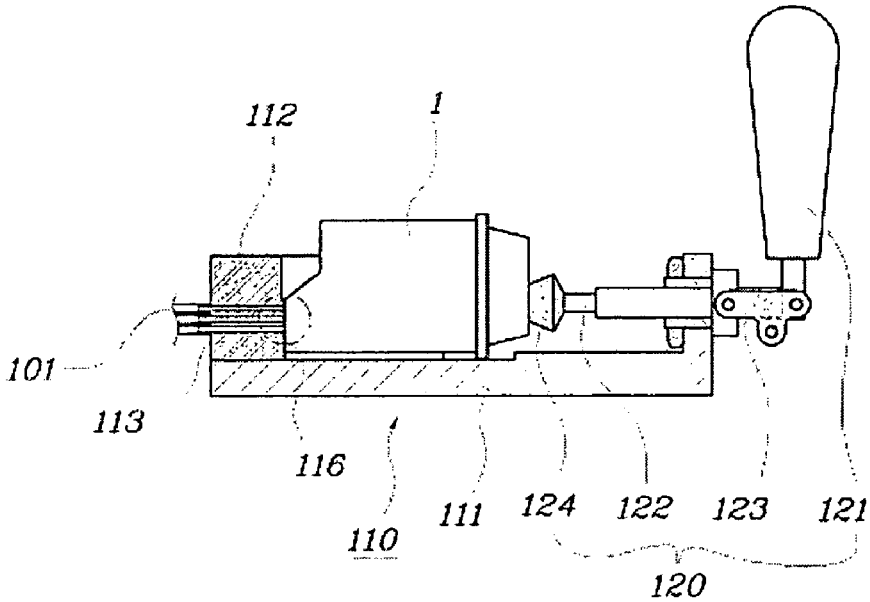
FIG. 3 Prior art
Figure 4:
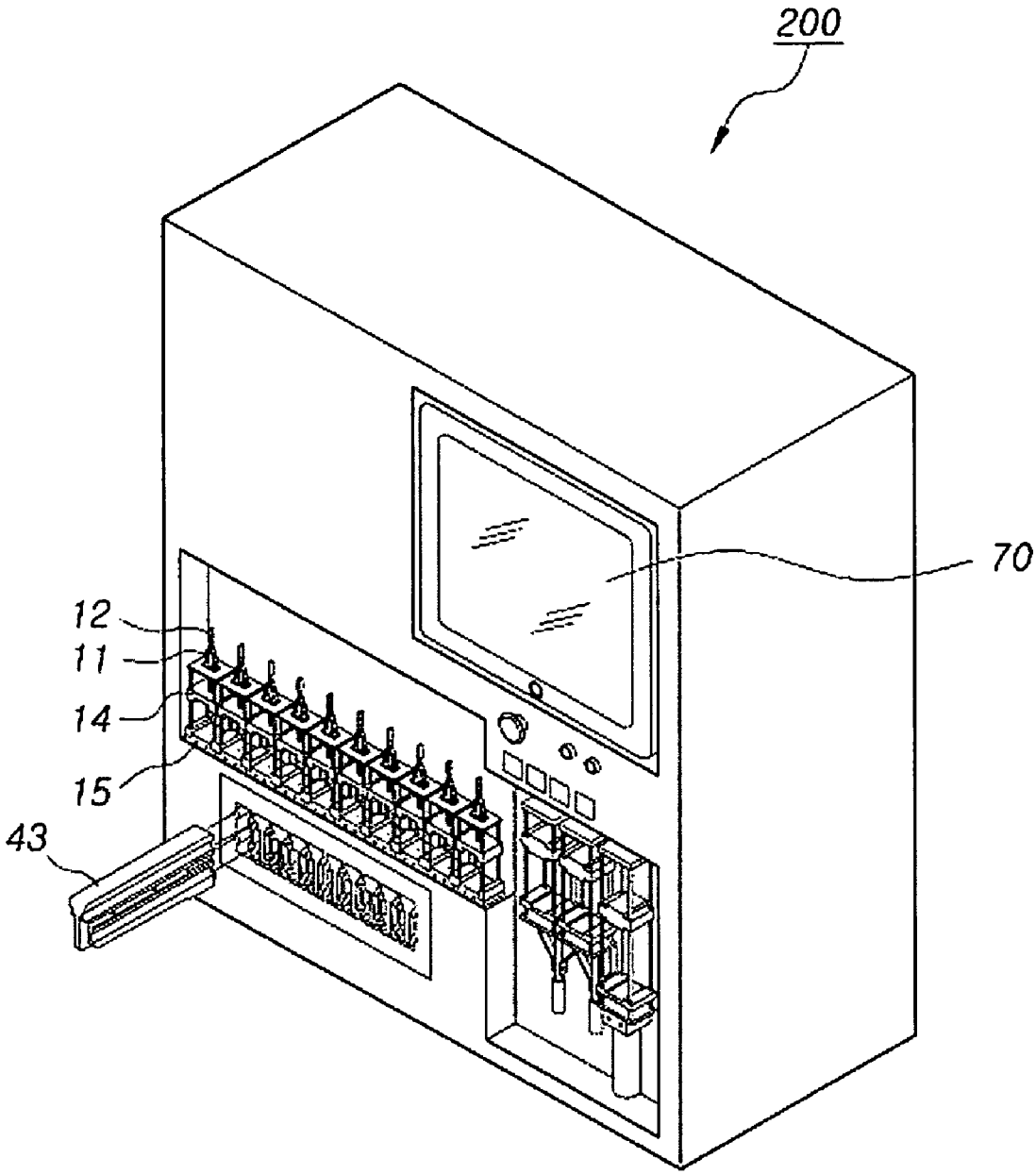
FIG. 4 is a front perspective view of an ink cartridge recharge system including a lever type attach and detach device according to the present invention.

FIG. 4 is a front perspective view of an ink cartridge recharge system including a lever type attach and detach device according to the present invention. In the right uppermost part, a touch screen 70 through which a worker can check the operation of the ink cartridge recharge system and can command input is provided. In the lowermost part, a plurality of large capacity bulk ink cartridges 43 in which black ink or color ink to be charged is stored are mounted.

Figure 5:
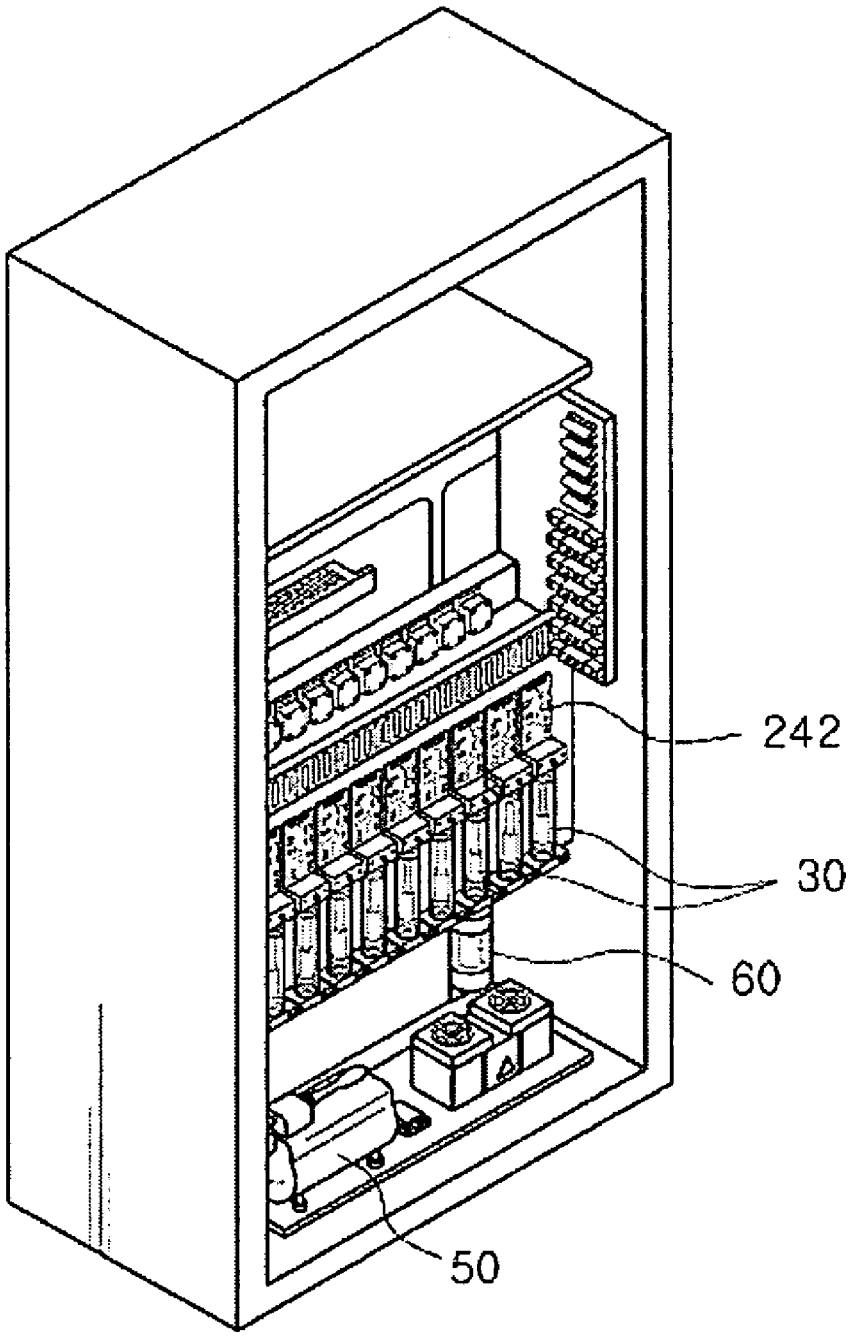
FIG. 5 is a rear perspective view of the ink cartridge recharge system illustrated in FIG. 4.

FIG. 5 is a rear perspective view of the ink cartridge recharge system illustrated in FIG. 4. A compressor 50 is fixed to the left lowermost part and a vacuum pump 60 is fixed in the right lowermost part. A plurality of magnetostrictive displacement transducers 30 run parallel to each other. Printed circuit boards (PCB) 242 positioned on the magnetostrictive displacement transducers 30 to regulate the up and down movement of floats in the magnetostrictive displacement transducers 30 are connected to the magnetostrictive displacement transducers 30, respectively.

Figure 6:
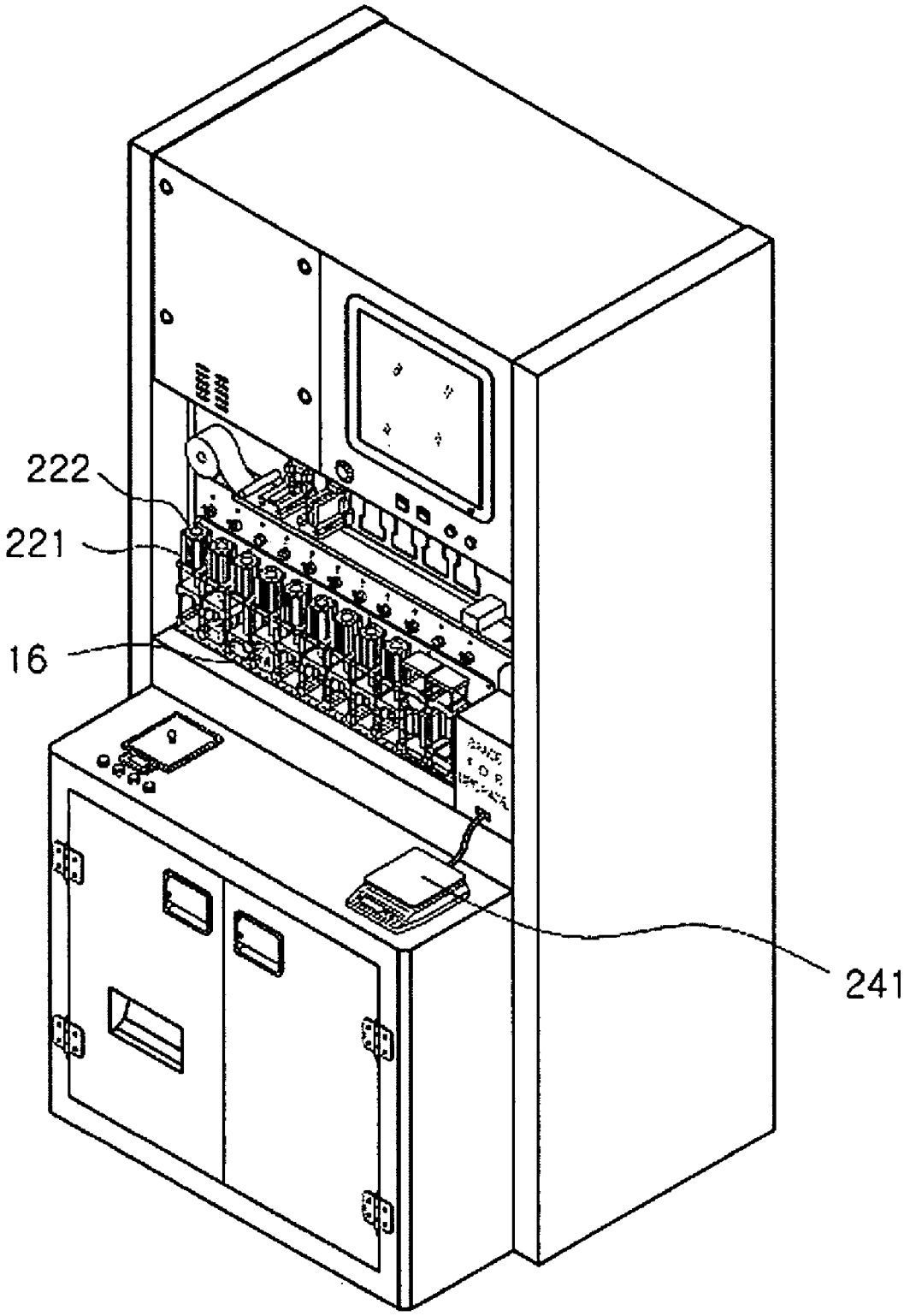
FIG. 6 is a front perspective view of an ink cartridge recharge system including a pneumatic cylinder type attach and detach device according to the present invention.

FIG. 6 is a front perspective view of an ink cartridge recharge system including a pneumatic cylinder type attach and detach device 221 according to the present invention. In the right uppermost part, a touch screen 70 through which a worker can check the operation of the ink cartridge recharge system and can command input is provided. In the center part, a pneumatic cylinder 222 in which the air pressure supplied by a compressor (not shown) is temporarily stored so that the pneumatic cylinder 222 is in a linear motion by the air pressure by a predetermined length is provided. A plurality of black ink and color ink cartridge mount holes run parallel to each other under the pneumatic cylinder 222. On the other hand, a recycle cartridge weight measuring electronic scale 241 is provided in a predetermined part of the center. The weight of the recycle ink cartridge placed on the electronic scale 241 is compared with a previously set value. When the comparison result is within an error range, it is determined that the amount of ink that resides in the ink cartridge is no more than an allowable amount so that it is allowed to recharge ink. When the comparison result is out of the error range, a warning message that informs that it is necessary to discharge the ink that resides in the ink cartridge is displayed on the touch screen.

Figure 7:
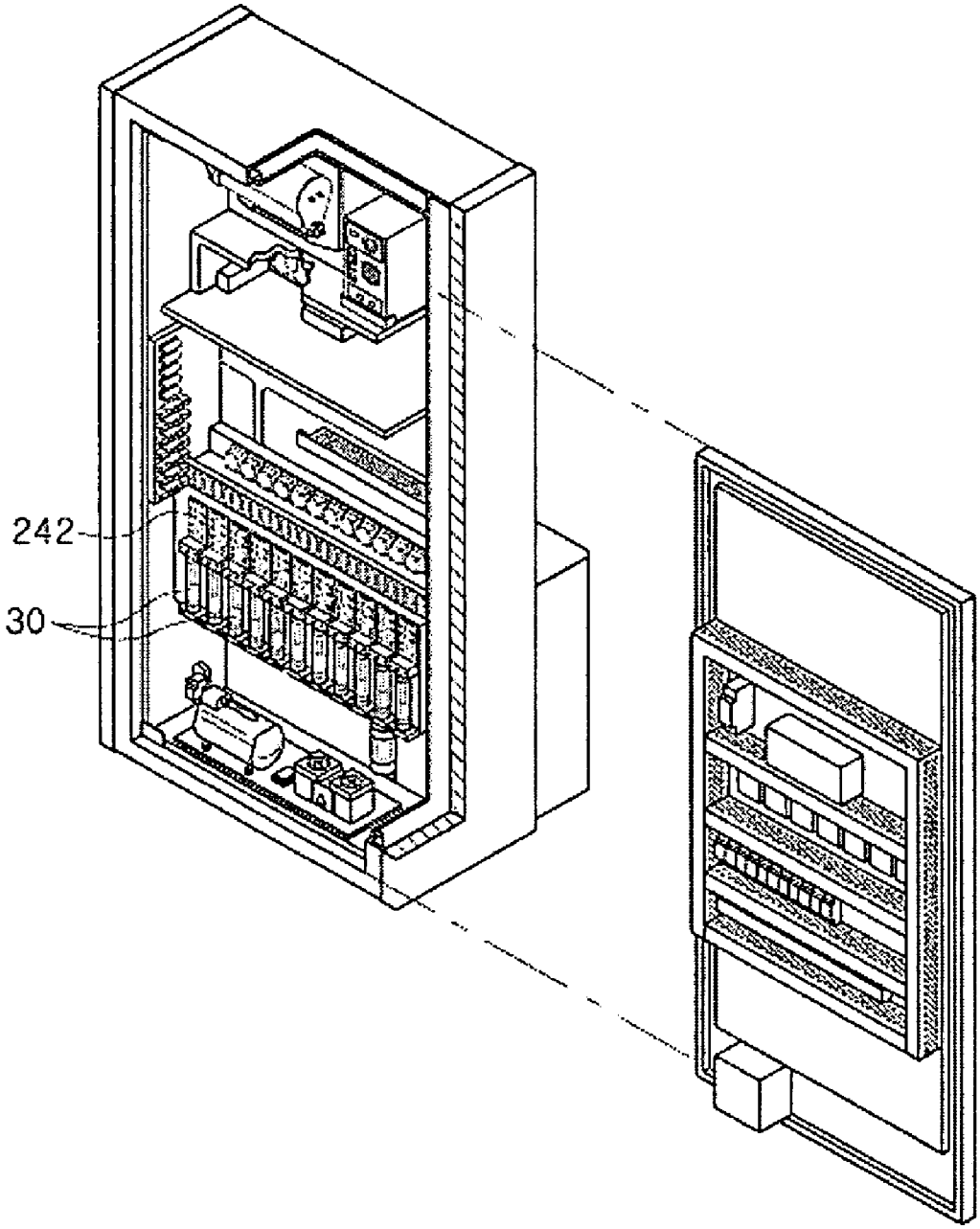
FIG. 7 is a rear perspective view of the ink cartridge recharge system illustrated in FIG. 6.

FIG. 7 is a rear perspective view of the ink cartridge recharge system illustrated in FIG. 6. In the lower part of the center, the plurality of magnetostrictive displacement transducers 30 run parallel to each other. The PCBs 242 positioned on the magnetostrictive displacement transducers 30 to regulate the pitch of floats in the magnetostrictive displacement transducers 30 are connected to the magnetostrictive displacement transducers 30, respectively.

Figure 8:
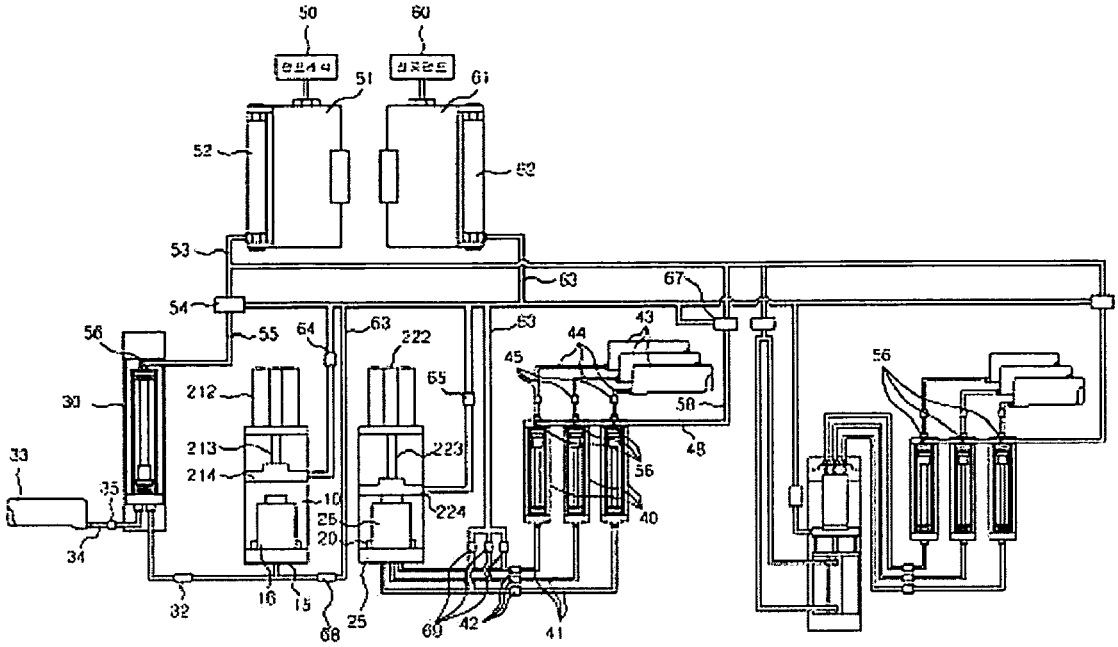
FIG. 8 illustrates the entire mechanism of the ink cartridge recharge system illustrated in FIGS. 6 and 7.

FIG. 8 illustrates the entire mechanism of the ink cartridge recharge system illustrated in FIGS. 6 and 7. The detailed operation of the ink cartridge recharge system will be described with reference to FIG. 8. First, a black ink cartridge 16 is settled in a cartridge amount hole 10 and then, the black ink cartridge 16 is mounted and fixed using a pneumatic cylinder 212 provided in the leading end of the pneumatic cylinder type attach and detach device 221. When it is ready to charge the ink, an open and close valve 68 provided in a vacuum tube 63 is opened in accordance with the command of the touch screen 70 to discharge the air from the ink cartridge so that the air and ink that reside in the black ink cartridge 16 are discharged through nozzles and that the internal pressure of the ink cartridge is regulated by a regulator. When the air and ink are completely discharged, a pneumatic solenoid valve 54 is opened in accordance with the input manipulation of a button that instructs to start charge so that the compressed air of a positive pressure tank 51 is supplied to a pneumatic regulator 56 of the magnetostrictive displacement transducer 30 through a pneumatic tube 53. When the float (not shown) in the magnetostrictive displacement transducer 30 moves by the compressed air, the black ink in the cylinder is supplied to the ink injection part 15 of the cartridge mount hole 10 through a black ink supply tube (not shown). Finally, the proper amount of black ink is charged in the nozzles (not shown) of the black ink cartridge 16 attached to and connected to an ink injection hole (not shown) through the ink injection hole of the ink injection part 15. At this time, the linear displacement of the float (not shown) in the magnetostrictive displacement transducer 30 is converted into current difference to be precisely regulated so that the proper amount of ink is charged.

On the other hand, when the ink is completely charged, a check valve 32 provided in the black ink supply tube 31 is closed. At the same time, when the vacuum tube 63 is connected to the pneumatic regulator 56 of the magnetostrictive displacement transducer 30 by the switch open and close operations of the pneumatic solenoid valve 54, the float (not shown) in the magnetostrictive displacement transducer 30 moves in the opposite direction so that negative pressure is applied to the inside of the magnetostrictive displacement transducer 30 and that the black ink in the bulk ink cartridge 33 is charged in the magnetostrictive displacement transducer 30 through the check valve 35 opened through the ink supply tube 34. After the ink is charged in the black ink cartridge 16 by the ink charge processes, the open and close valve 64 provided in the vacuum tube 63 is opened to suck a small amount of ink through the nozzles of the ink cartridge 16 so that the internal pressure of the ink cartridge 16 is regulated and that the nozzles filled with ink are mounted in a printer to perform printing. As a result, ink is completely charged. The series of processes are repeated to fill ink in another ink cartridge.

In the center of FIG. 8, the structure of an ink cartridge recharge system in which cyan ink, magenta ink, and yellow ink are simultaneously charged in color ink cartridges is illustrated. The detailed operation of the color ink recharge system will be described as follows. First, a color ink cartridge 26 is settled in a cartridge amount hole 20 and then, the pneumatic cylinder 222 provided in the leading end of the pneumatic cylinder type attach and detach device 221 is operated upward and downward to mount and fix the color ink cartridge 26.

When it is ready to charge the ink, in accordance with the command of the touch screen 70 to discharge the air from the ink cartridge, the vacuum tube 63 is divided to be connected to color ink supply tubes 41 and open and close valves 69 provided in the centers of the tubes are opened so that the air and ink that reside in the color ink cartridge 26 are discharged through nozzles. The internal pressure of the ink cartridge is regulated by a regulator. When the air and ink are completely discharged, the command of the touch screen 70 to start charge is input so that a pneumatic solenoid valve 67 is opened and that the compressed air of the positive pressure tank 51 is supplied to the pneumatic regulators 56 of magnetostrictive displacement transducers 40 through the pneumatic tube 53. Then, the three color ink components stored in the magnetostrictive displacement transducers 40 are supplied to a color ink injection part 25 of a cartridge mount hole 20 through the color ink supply tubes 41 by the movement of floats (not shown) in the magnetostrictive displacement transducers 40. Finally, the three color ink components are charged in the nozzles 28 of the color ink cartridge 26 attached and connected to color ink injection holes 27 through the color ink injection holes 27 divided into the respective colors in the color ink injection part 25. At this time, the linear displacement of the floats (not shown) in the magnetostrictive displacement transducers 40 is converted into current difference to be precisely controlled so that the proper amounts of color ink components are charged.

On the other hand, when the color ink is completely charged, check valves 42 provided in the color ink supply tubes 41 are closed. At the same time, when the vacuum tube 63 is connected to the pneumatic regulators 56 of the magnetostrictive displacement transducers 40 by the open and close operations of the pneumatic solenoid valve 67, the floats (not shown) in the magnetostrictive displacement transducers 40 move in the opposite direction so that the negative pressure is applied to the insides of the magnetostrictive displacement transducers 40 and that the color ink of bulk ink cartridges 43 is charged in the magnetostrictive displacement transducers 40 through check valves 45 opened through color ink supply tubes 44. After the ink is charged in the color ink cartridge 26 by the ink charge processes, the open and close valve 65 provided in the vacuum tube 63 is opened to suck a small amount of ink through the nozzles of the color ink cartridge 26 so that the internal pressure of the color ink cartridge 26 is regulated and that the nozzles filled with ink are mounted in a printer to perform printing. As a result, ink is completely charged. The series of processes are repeated to fill ink in another ink cartridge.

On the other hand, a supplementary positive pressure tank 52 is provided in front of the compressor 50 and a sensor (not shown) that senses the internal pressure of the supplementary positive pressure tank is provided in the supplementary positive pressure tank 52. The supplementary positive pressure tank 52 temporarily stores the compressed air generated by the compressor 50 and supplies the compressed air of proper pressure to the magnetostrictive displacement transducers 40 through the pneumatic tube 53.

Air holes may be provided in the upper parts of some ink cartridges. In this case, the air hole of the ink cartridge and an air discharge hole 29 formed in each of air discharge parts 214 and 224 of the ink cartridge mount holes are tightly connected to each other and a vacuum pump 60 operates in the processes of charging the ink so that the ink cartridge is made vacuous by the vacuum tube 63 to facilitate charge of ink in the ink cartridge.

Figure 9:
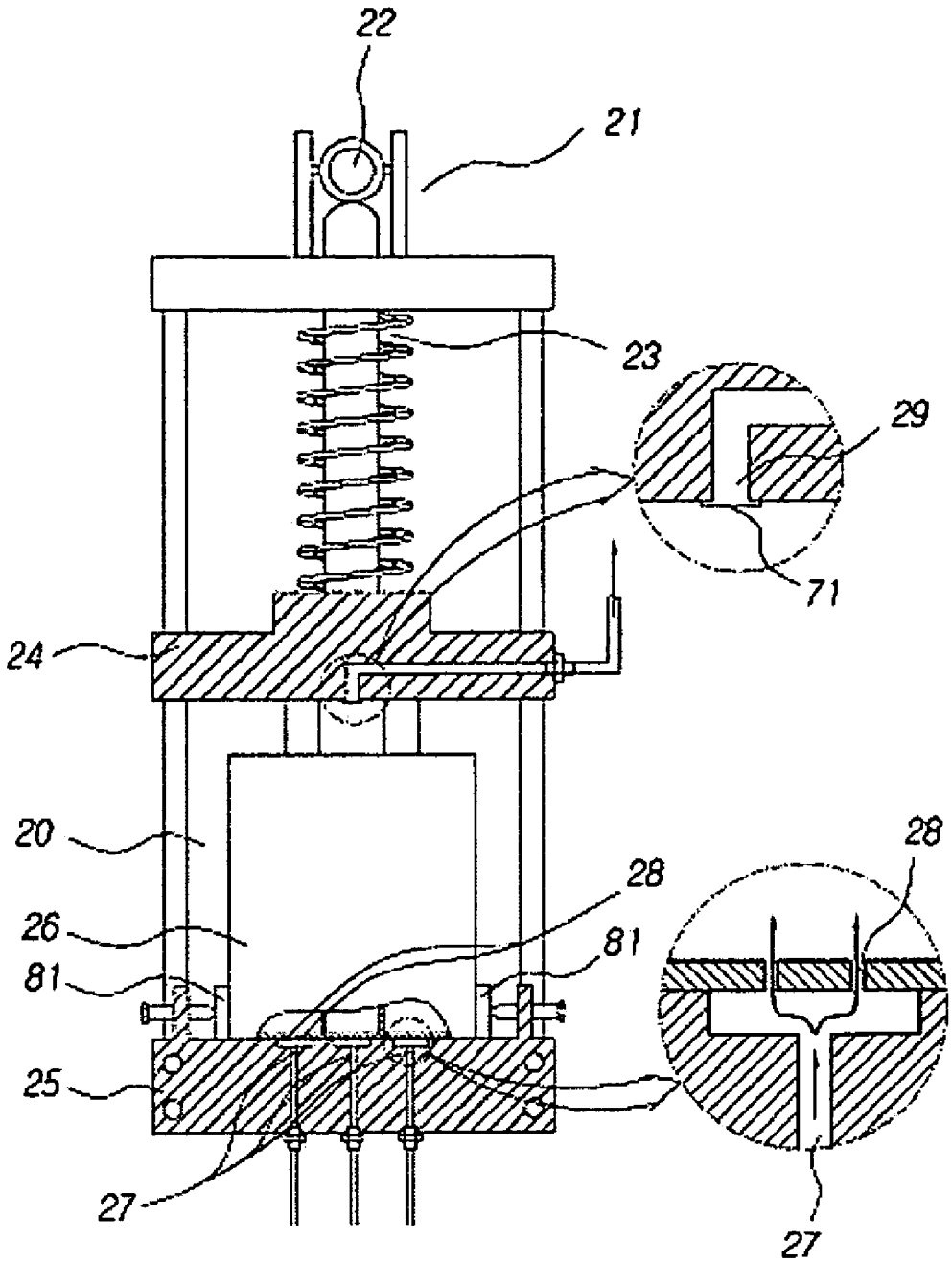
FIG. 9 illustrates that the air is discharged from and the ink is charged in a color ink cartridge mounted in the ink cartridge mount hole including the lever type attach and detach device.

FIG. 9 illustrates the structures of a lever type cartridge mount hole 20, a cartridge fix member 21, and the color ink cartridge 26 mounted in and fixed to the cartridge mount hole 20. The cartridge fix member 21 includes a handle 22, a sliding bar 23, and an air discharge part 24. The color ink cartridge 26 is attached and fixed to the cartridge mount hole 20 so that the nozzles 28 of the color ink cartridge 26 are tightly connected to the color ink injection holes 27 of the color ink injection part 25 by the 90° rotation of the handle 22. According to the conventional art, an elastic member 124 made of rubber is combined with the leading end of a sliding bar 122. On the other hand, according to the present invention, ink cartridge fix pressure is properly regulated using a spring of a sliding bar 23 so that the spring is permanently used compared with the elastic member 124 and that uniform pressure can be applied although the spring is continuously used.

Figure 10:
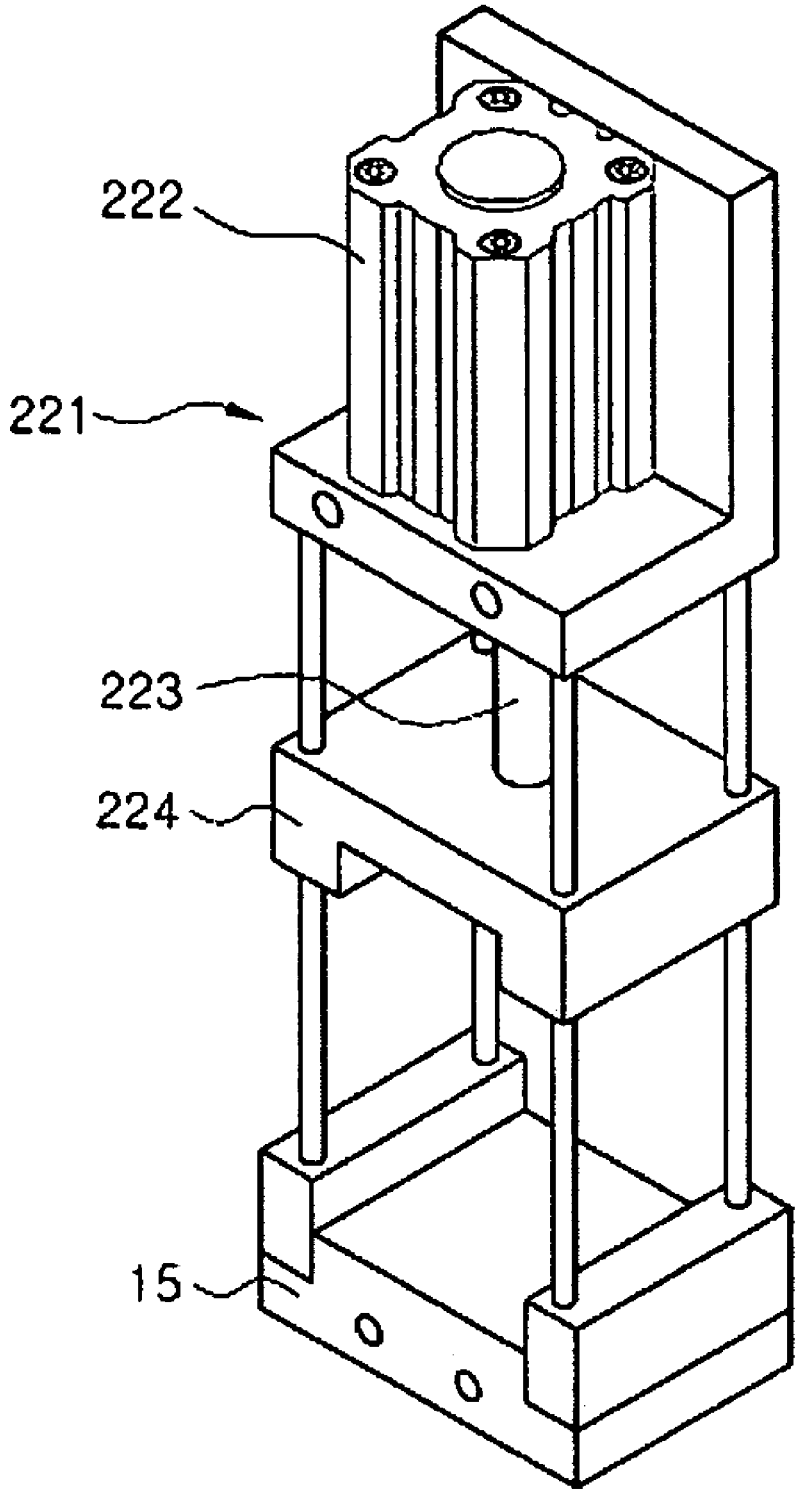
FIG. 10 illustrates the pneumatic cylinder type attach and detach device.

FIG. 10 illustrates the pneumatic cylinder type attach and detach device 221 according to another embodiment of the ink cartridge fix member. The pneumatic cylinder type attach and detach device 221 includes a pneumatic cylinder 222 provided in the upper or lower part where the ink cartridge is mounted to store the compressed air supplied by the compressor (not shown) and a sliding bar 223 and an air discharge part 224 for transmitting the air pressure of the pneumatic cylinder 222. According to the pneumatic cylinder type attach and detach device 221, the color ink cartridge 26 is mounted in and attached and fixed to the cartridge mount hole 20 so that the nozzles 28 of the color ink cartridge 26 are tightly connected to the color ink injection holes 27 of the color ink injection part 25 by the linear motion of the sliding bar 223 caused by a signal and the air pressure of the pneumatic cylinder 222.

Air holes may be provided in the upper parts of some ink cartridges. In this case, the air hole 71 of the color ink cartridge 26 and the air discharge hole 29 of the air discharge part 24 are tightly connected to each other.

As described above, before charging the color ink, the air and ink that reside in the color ink cartridge 26 are discharged through the nozzles 28 of the ink cartridge 26 by the suction force of a negative pressure tank 61 made vacuous by the vacuum pump. During charge, the cyan ink, the magenta ink, and the yellow ink that are stored in the magnetostrictive displacement transducers 40 are charged in the color ink cartridge 26 through the ink injection holes 27 in the lower part and the nozzles 28 corresponding to the color ink cartridge 26 by the air pressure applied to the magnetostrictive displacement transducers 40.

The cartridge mount hole 20 may further include a side guide member 81 to freely correspond to the width and depth of the settled cartridge regardless of the size and shape of the settled color ink cartridge 26 unlike in the conventional art. Also, the plurality of attachable and detachable ink injection parts 25 each having the ink injection holes 27 suitable for the size and shape of the nozzles are included so that ink can be injected into all of the products of the color ink cartridge manufacturing companies. If necessary, the ink injection part 25 can be replaced by the ink injection part 25 having the ink injection holes 27 of a specific standard.

Figure 11:
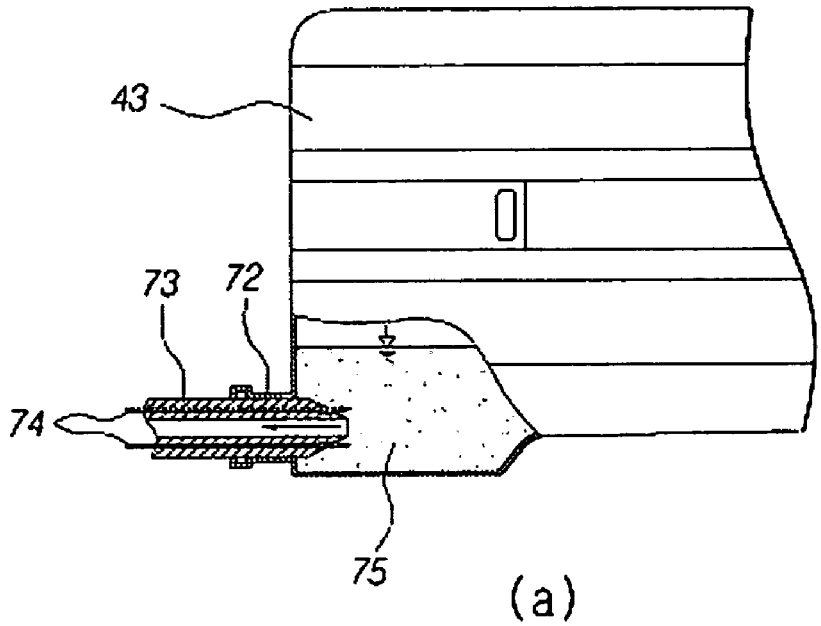
FIGS. 11A and 11B illustrate the structure of an electrode rod that detects whether ink in a bulk ink cartridge is consumed.
Figure 11:
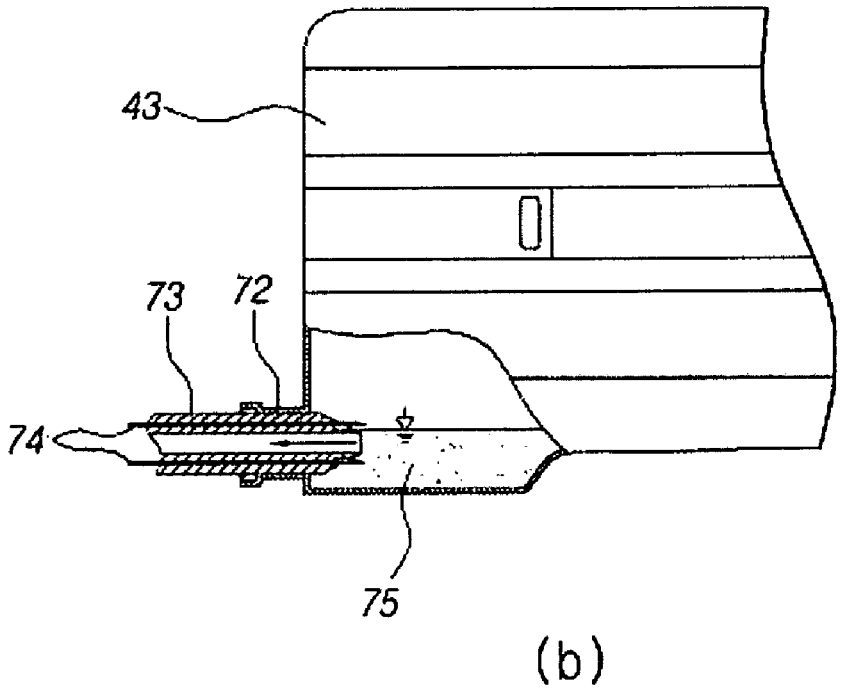

FIGS. 11A and 11B illustrate how to determine whether ink is supplied to and consumed in the bulk ink cartridge 43. The bulk ink cartridge 43 is mounted in the additional mount member to be attachable and detachable so that the bulk ink cartridge 43 can be replaced by a new bulk ink cartridge when the stored ink is consumed. A sensor that senses whether the bulk ink cartridge 43 is mounted is provided and information from the sensor is transmitted to the regulator (not shown). In order to determine whether the ink in the bulk ink cartridge 43 is consumed, an ink supply tube 73 is forcibly inserted into and fastened to a circular pipe-shaped protrude part 72 in a lower part, electrode teeth 74 having different heights are inserted into the upper and lower parts of the ink supply tube 73 so that the ends of the electrode teeth 74 are exposed to the ink. The electrode teeth 74 determine whether the ink is consumed using the conductivity of the ink charged in the ink cartridge. When the ink is full, the electrode rod flows electricity through the ink. However, when the ink is consumed so that the water level of the ink is positioned between the upper and lower electrode teeth 74, electricity does not flow between the electrode teeth through the ink so that it is possible to easily check whether the ink in the bulk ink cartridge is consumed through a flickering light emitting diode (LED) (not shown) by the conduction signal.

In the ink cartridge recharge system illustrated in FIGS. 4 to 7, the nozzles of the ink cartridge face downward. However, the nozzles may be arranged in the opposite direction in accordance with a design.

According to the ink cartridge recharge system having the above structure, the air and ink that reside in the ink cartridge are discharged through the nozzles of the ink cartridge before charging the ink and the ink cartridge is made vacuous in the processes of charging the ink cartridge through the air hole additionally provided to face the nozzles of the ink cartridge to effectively regulate the speed of charging the ink. Also, pressure is precisely regulated by the nozzles so that air bubbles are not left in the nozzles so that it is possible to smoothly charge the ink in the ink cartridge.

Also, the precise displacement of the floats in the magnetostrictive displacement transducers is converted into change in current difference so that it is possible to precisely measure and control the amount of the charged ink.

On the other hand, small amounts of the air and ink in the recharged ink cartridge are taken out when the ink is completely charged to regulate the internal pressure of the ink cartridge. If necessary, the ink that resides in the ink cartridge may be taken out at the initial stage of recharging of the ink.

The ink may be charged in the ink cartridge by simply manipulating the button of the touch screen provided on one side and the worker can watch and manage the processes of recharging the ink through the touch screen.

What is claimed is:

1. An ink cartridge recharge system comprising:

an ink cartridge mount hole in which an ink cartridge is mounted and that includes an ink injection part in which an ink injection hole connected to a nozzle of the ink cartridge is formed;

a magnetostrictive displacement transducer which is connected to the ink injection hole through an ink supply tube and determines the charged amount of ink by sensing displacement of magnetic field due to displacement of an internal float;

a positive pressure tank in which high pressure air is stored by a compressor;

a bulk cartridge connected to one side of the magnetostrictive displacement transducer to supply ink to be charged; and a negative pressure tank made vacuous by a vacuum pump and connected to the ink injection hole of the ink cartridge mount hole through a vacuum tube.

2. The ink cartridge recharge system as claimed in claim 1, wherein the ink cartridge mount hole further comprises an air discharge part in which an air discharge hole connected to an air hole of the ink cartridge is formed, the air discharge hole formed to face the ink injection hole.

3. The ink cartridge recharge system as claimed in claim 2, wherein the ink cartridge mount hole further comprises a fix member for settling and mounting an ink cartridge and for fixing the ink cartridge so that the nozzle of the ink cartridge and the ink injection hole and the air hole of the ink cartridge and the air discharge hole of the air discharge part are tightly connected to each other.

4. The ink cartridge recharge system as claimed in claim 3, wherein the fix member comprises a handle, a sliding bar, and a spring.

5. The ink cartridge system as claimed in claim 3, wherein the fix member comprises a pneumatic cylinder and a sliding bar.

6. The ink cartridge system as claimed in claim 1, wherein the ink cartridge mount hole further comprises a side guide member that can freely move in accordance with the width and depth of the ink cartridge so that ink cartridges of various specification can be stably fixed on a lower part of the ink cartridge mount hole.

7. The ink cartridge recharge system as claimed in claim 1, wherein the ink cartridge recharge system include a plurality of ink cartridge mount holes.

8. The ink cartridge recharge system as claimed in claim 1, wherein the ink injection part includes a plurality of ink injection holes, through which different colored inks are recharged.

9. The ink cartridge recharge system as claimed in claim 1, wherein the ink cartridge recharge system comprises both a plurality of black ink injection parts and colored ink injection parts.

10. The ink cartridge recharge system as claimed in claim 1, wherein the compressed air supply tube comprises a pneumatic solenoid valve for alternately connecting a pneumatic tube and a vacuum tube to pneumatic regulators of the magnetostrictive displacement transducers in accordance with an ink charge period to regulate opening and closing.

11. The ink cartridge recharge system as claimed in claim 1, further comprising two conductive electrode teeth having different heights to determine whether ink stored in the bulk ink cartridge is consumed.

12. The ink cartridge recharge system as claimed in claim 1, wherein an electronic scale for measuring weight of an ink cartridge is provided in a predetermined part of the ink cartridge recharge system.

13. The ink cartridge recharge system as claimed in claim 12, wherein a message that informs whether the amount of ink that resides in the ink cartridge is allowable in accordance with the weight of the ink cartridge measured by the electronic scale is displayed on a touch screen.

14. A method of recharging an ink cartridge using an ink cartridge recharge system, the method comprising:

mounting an ink cartridge in an ink cartridge mount hole;

discharging air and ink that reside in the ink cartridge by opening and closing operations of an open and close valve provided in a vacuum tube that connects a negative pressure tank and ink cartridge nozzles to each other;

connecting a vacuum tube to pneumatic regulators of magnetostrictive displacement transducers by opening and closing operations of a pneumatic solenoid valve provided in a branch of compressed an air supply tube from a positive pressure tank and a branch of a vacuum tube from a negative pressure tank so that negative pressure is applied to the magnetostrictive displacement transducers and that a proper amount of ink is supplied from bulk ink cartridges;

connecting the pneumatic regulators of the magnetostrictive displacement transducers and a pneumatic tube to each other by changed opening and closing operations of the pneumatic solenoid valve to charge the ink of the magnetostrictive displacement transducers in the ink cartridge through ink supply tubes;

stopping ink supply of the magnetostrictive displacement transducers when it is determined by a proper amount level control means that a proper amount of ink is supplied; and sucking air and ink that reside in the ink cartridge or ink injection holes by opening and closing operations of an open and close valve provided in the vacuum tube.

15. The method as claimed in claim 14, further comprising the operation of facilitating ink charge to the ink cartridge by the opening and closing operations of the open and close valve provided in the vacuum tube that connected the air hole of the ink cartridge in the charging operation.

* * * * *